US008091885B2

(12) United States Patent
Conaway et al.

(10) Patent No.: US 8,091,885 B2
(45) Date of Patent: Jan. 10, 2012

(54) MAIL DOUBLES DETECTION AND CORRECTION SYSTEM

(75) Inventors: Brant A. Conaway, Marriottsville, MD (US); Thomas A. Hillerich, Louisville, KY (US); Jacob L. Timm, Pasadena, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 21 days.

(21) Appl. No.: 12/500,760

(22) Filed: Jul. 10, 2009

(65) Prior Publication Data

US 2011/0006470 A1 Jan. 13, 2011

(51) Int. Cl.
*B65H 3/34* (2006.01)

(52) U.S. Cl. ..... 271/104; 271/2; 271/260

(58) Field of Classification Search ..... 271/2, 104, 271/260, 262, 263, 265.04, 274, 284
See application file for complete search history.

(56) References Cited

U.S. PATENT DOCUMENTS 3,040,866 A * 6/1962 Rehm ..... 198/357
4,702,471 A * 10/1987 Smith et al. ..... 271/284
4,772,008 A * 9/1988 Spencer et al. ..... 271/284
5,509,648 A * 4/1996 Chen et al. ..... 271/260
6,027,113 A * 2/2000 Reljic ..... 271/260
6,494,446 B1 * 12/2002 Tomiyama et al. ..... 271/91
7,775,520 B2 * 8/2010 Matsudaira et al. ..... 271/284
2009/0057998 A1 * 3/2009 Ong ..... 271/276

* cited by examiner

*Primary Examiner* — Jeremy R Severson
(74) *Attorney, Agent, or Firm* — Rothwell, Figg, Ernst & Manbeck, P.C.

(57) ABSTRACT

A mail doubles detection and correction system for a mail processing system with a feeder includes a mail support configured to support at least two mail pieces in a detection space downstream of the feeder, a pair of vacuum belt assemblies disposed on opposite sides of the detection space, and one or more sensors positioned about the detection space to detect a position of one or more mail pieces in the detection space. Each vacuum belt assembly includes a vacuum port facing the detection space and a perforated belt movable across the vacuum port in a mail transport direction. The system detects a mail double when the sensors indicate that more than one mail piece is disposed in the detection space and corrects the situation by moving one of the belts and holding the other belt stationary to advance only one of the mail pieces, and subsequently moving both of the belts to advance the remaining mail piece. The system detects a normal feed when the sensors indicate only one mail piece in the detection space, in which case both of the belts are moved to advance the mail piece. The system can also be configured to automatically adjust a width of the detection space to accommodate mail pieces having a range of widths.

20 Claims, 10 Drawing Sheets

MAIL DOUBLES DETECTION AND CORRECTION SYSTEM

BACKGROUND OF THE INVENTION

I. Field of the Invention

The present invention relates generally to mail processing systems and, more particularly, to an anti-doubling detection and correction system for use in mail processing systems.

II. Discussion of the Background Art

Mail processing systems, such as mail sorters, typically include one or more feeders designed to singulate an individual mail piece from a stack of mail for downstream processing. FIG. 1 shows a top view of a mail feeder 100 for an automated mail sorting machine (AFSM) commonly used by the U.S. Postal Service. The mail feeder 100 includes a conveyor belt 102 with a horizontal run moving in a first direction A and a feeder plate 104 at a terminal end of the conveyor belt perpendicular to the horizontal run. Mail pieces M are stacked on edge in a generally vertical orientation on the conveyor belt 102 and moved in the first direction A toward the feeder plate 104. As the mail stack approaches the feeder plate 104, the leading mail piece at the front of the stack is dropped from the feeder belt and drawn against the feeder plate by vacuum ports 106 formed in the plate. The mail piece is then launched in a second direction B, transverse to the first direction A, by rotation of a perforated belt 108 looped through a pair of windows 110 on opposite sides of the vacuum ports 106 in the plate. Intermittent vacuum sources 112*a* and 112*b* behind the perforated belt 108 draw the mail piece against the belt to overcome friction between the leading mail piece and other mail pieces in the stack.

Often times a second mail piece is unintentionally pulled along with the first mail piece as a result of friction, electrostatic charges, adhesion, pressure or other forces acting on the mail stack. When two or more pieces are pulled into the sorting machine, the second piece is sorted based upon the destination of the first piece. This situation may not be detected until both mail pieces are much further in the mail delivery process, resulting in mishandling and additional cost to the customer for re-sorting. In an attempt to avoid this situation, current mail feeding technologies use some form of fixed anti-doubling mechanism 114 on one side of the mail to hold back mail pieces that are not intended to be fed into the sorting system while the leading mail piece is grabbed by rotating pinch wheels 116. However, existing anti-doubling mechanisms are not always effective and can damage certain types of mail, such as poly-wrapped, stapled and open mail.

SUMMARY OF THE INVENTION

The present invention overcomes disadvantages of the prior art by providing a mail doubles detection and correction system that can distinguish between mail doubles and other types of mail, such as poly-wrapped, stapled and open mail.

An aspect of the invention is a mail doubles detection and correction system for a mail processing system with a feeder. The system includes a mail support configured to support at least two mail pieces in a detection space downstream of the feeder, a pair of vacuum belt assemblies disposed on opposite sides of the detection space, and one or more sensors positioned about the detection space to detect a position of one or more mail pieces in the detection space. Each vacuum belt assembly includes a vacuum port facing the detection space and a perforated belt movable across the vacuum port in a mail transport direction. The system detects a mail double when the sensors indicate that more than one mail piece is disposed in the detection space and corrects the situation by moving one of the belts and holding the other belt stationary to advance only one of the mail pieces, and subsequently moving both of the belts to advance the remaining mail piece. The system detects a normal feed when the sensors indicate only one mail piece in the detection space, in which case both of the belts are moved to advance the mail piece. The system can also be configured to automatically adjust a width of the detection space to accommodate mail pieces having a range of widths.

Another aspect of the invention is a method of detecting and correcting mail doubles by receiving one or more mail pieces in a detection space between a pair of perforated belts; drawing a vacuum on each side of the detection space; sensing proximity of the one or more mail pieces at vertically spaced locations on opposite sides of the detection space and a bottom of the detection space; determining whether one or more mail pieces are disposed in the detection space based on the sensing step; and selectively moving one or both belts based on the determining step.

Some of the advantages that may be obtained by practicing the present invention include an ability to detect and correct mail doubles effectively without damaging the mail or decreasing feeder throughput, a reduction in costs associated with downstream processing of mail doubles, an ability to handle open, poly-wrapped and other types of mail, and compatibility with existing mail processing equipment.

Other features and advantages of the invention will become apparent to those of skill in the art upon reviewing the following detailed description of the preferred embodiments and the accompanying drawings.

BRIEF DESCRIPTION OF THE DRAWINGS

The accompanying drawings, which are incorporated herein and form part of the specification, illustrate a preferred embodiment of the present invention and, together with the detailed description, further serve to explain the principles of the invention and to enable a person skilled in the art to make and use the invention. In the drawings, like reference numbers are used to indicate identical or functionally similar elements.

DETAILED DESCRIPTION OF THE PREFERRED EMBODIMENTS

Figure 2:
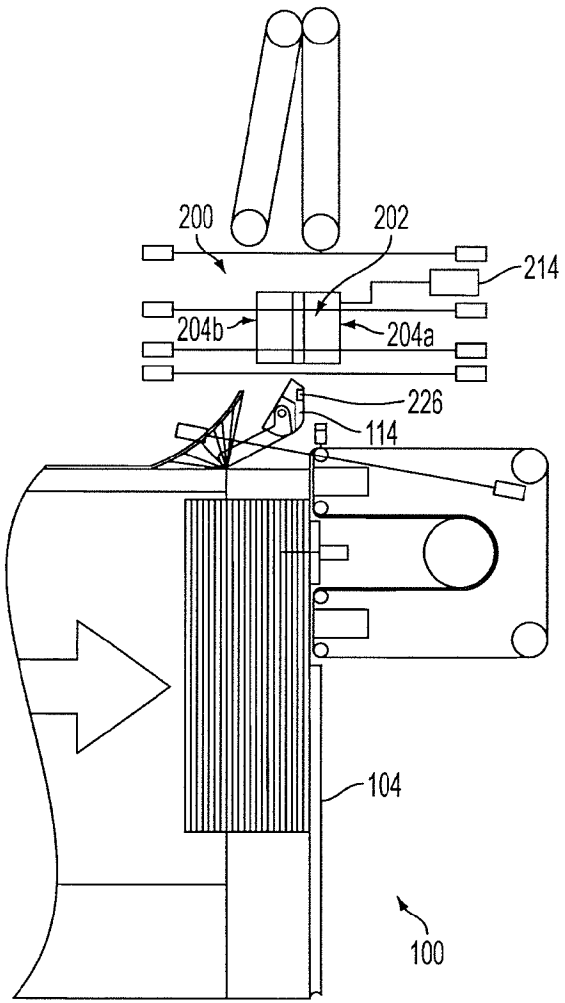
FIG. 2 is a top view of a mail doubles detection and correction system according to an embodiment of the present invention.
Figure 3:
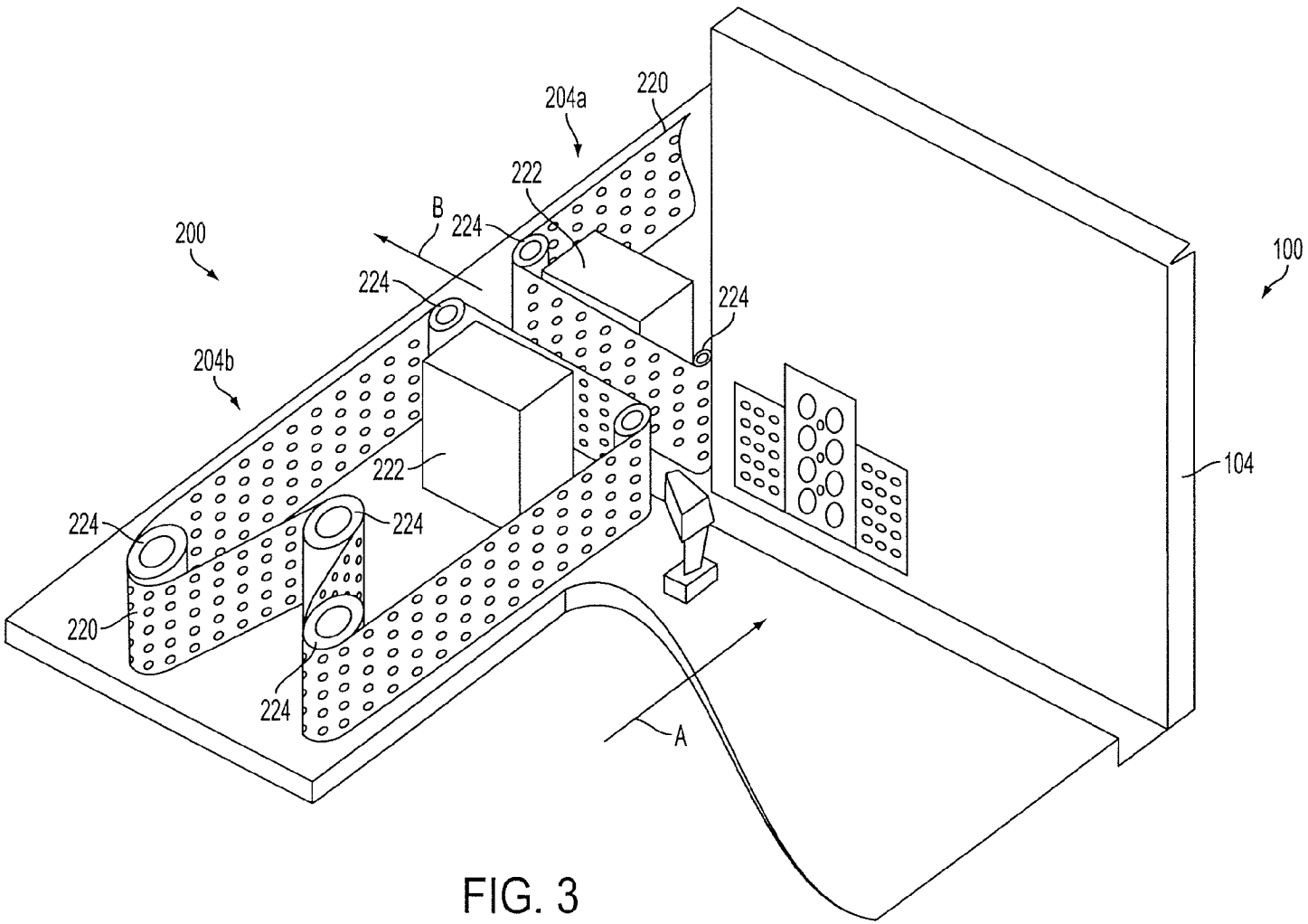
FIG. 3 is a perspective view of a mail doubles detection and correction system according to an embodiment of the present invention.

A mail doubles detection and correction system 200 according to an embodiment of the present invention is shown in relation to a mail feeder 100 in FIGS. 2 and 3. In this embodiment, the system 200 replaces the pinch wheels 116 of the otherwise conventional feeder 100. The system 200 includes a mail support 202 positioned downstream of the feeder 100 in alignment with the fixed anti-doubler 114 of the feeder and a pair of perforated vacuum belt assemblies 204*a* and 204*b* disposed on opposite sides of the mail support. Referring to the cross-sectional views in FIGS. 4 and 5, it can be seen that the system 200 includes a plurality of sensors 206, 208*a* & 208*b*, 210*a* & 210*b*, and 212*a* & 212*b*, disposed about the channel 202 and the vacuum belt assemblies 204*a* & 204*b* to detect the presence of one or more mail pieces M within a detection space S defined therebetween. A computerized controller 214 determines in real time whether one or more mail pieces are present in the detection space S based on input from the sensors and controls operation of the vacuum belt assemblies to singulate the one or more mail pieces before further downstream processing.

Figure 5:
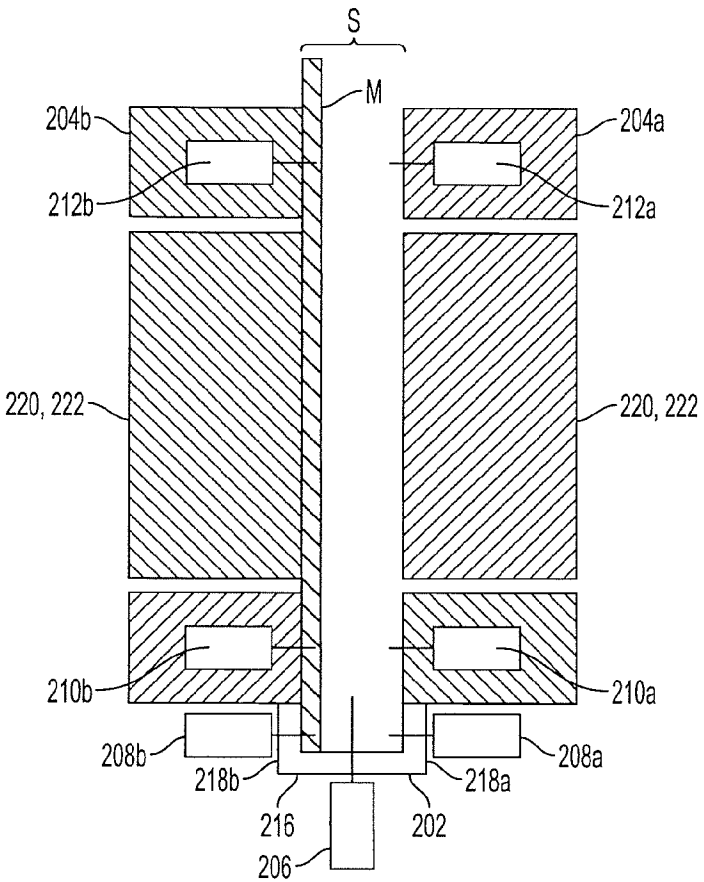
FIGS. 4 and 5 are cross-sectional views of a mail doubles detection and correction system according to an embodiment of the present invention, showing operation of the system when a single mail piece is fed into the system by the feeder.
Figure 4:
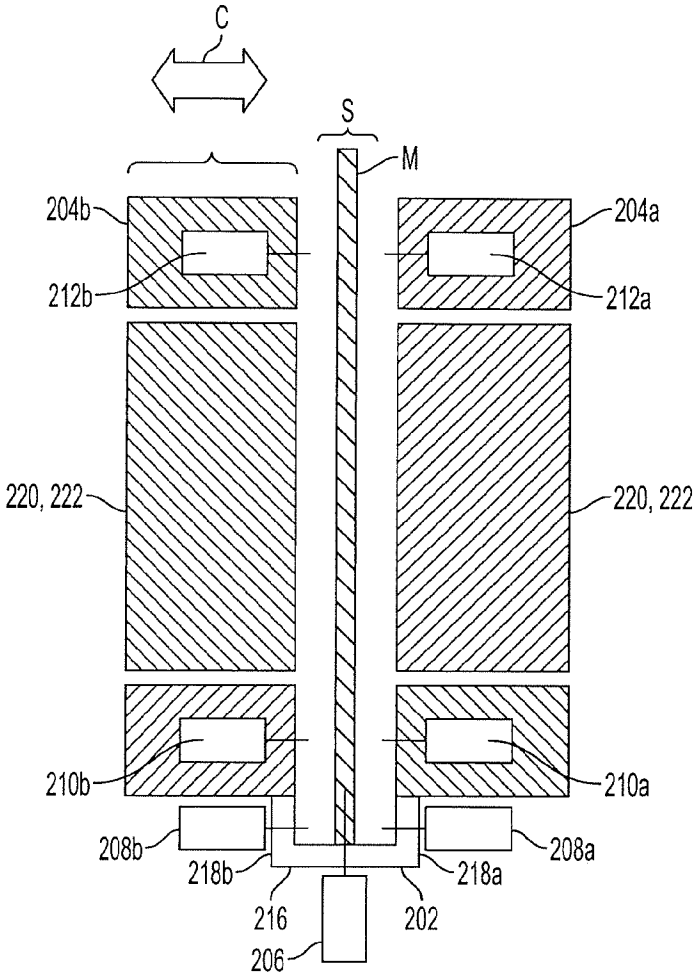

In the embodiment shown in FIGS. 4 and 5, mail support 202 is an elongate channel with a horizontal bottom 216 having a central longitudinal axis oriented parallel to the plane of feed plate 104 and sides 218*a* & 218*b* extending vertically upward from opposite lateral edges of the bottom. Mail support 202 is positioned to receive vertically oriented mail pieces M from the feeder 100 and to support the mail pieces on edge in a generally vertical orientation within the detection space S so that planar sides of the mail pieces face the vacuum belt assemblies 204*a* & 204*b*. In an embodiment, the support 202 has a width large enough to accommodate multiple mail pieces between the vacuum belt assemblies 204*a* & 204*b*. Alternatively, one side of the support 202 can be made to move perpendicular to the direction of travel of the mail (see FIG. 4 at C) so that the width of the detection space S can be adjusted based on mail thickness.

As best seen in FIG. 3, each vacuum belt assembly 204*a* & 204*b* includes a perforated belt 220 and a vacuum manifold 222 that draws vacuum through the belt. The vacuum manifold 222 faces the detection space and the belt 220 is mounted on rollers 224 to create a run that is driven across the vacuum manifold in the direction of mail transport path B. It will be appreciated that belts 220 on opposite sides of the detection space are rotated in opposite directions to create a pair of opposed linear runs that can be moved in the same direction B across the vacuum manifolds. In an embodiment, one or more of the rollers 224 are driven by servo motors which are selectively operated by the controller 214 in response to input from the sensors, in order to selectively move the belts 220 as described in greater detail below.

Referring again to FIGS. 4 and 5, the mail detection sensors preferably include high, medium and low side sensors 212*a* & 212*b*, 210*a* & 210*b*, and 208*a* & 208*b*, respectively, facing inwardly at vertically spaced locations along each side of the detection space S and a bottom sensor 206 facing upwardly from the bottom 216 of the mail support channel 202. In an embodiment, the low side sensors 208*a* & 208*b* are positioned along opposite sides 218*a* & 218*b* of the mail support channel 202 and bottom sensor 206 is located along the central longitudinal axis of the mail support channel bottom 216. The high, medium and low sensors on each side of the detection space S are preferably short range sensors capable of detecting the presence of mail against the inside walls or surfaces of the support channel 202 and the vacuum belt assemblies 204*a* & 204*b*. Examples of suitable sensors include, but are not limited to, short range photoelectric, mechanical, capacitive or ultrasonic sensors.

In operation, the system 200 receives one or mail pieces M from the feeder 100 with the opposed belts 220 and the opposed vacuum sources 222 running, performs a mail doubles detection by sensing the profile of the mail pieces reacting to the opposed vacuum sources, and if necessary stops one of the belts to hold back any doubles while the other belt continues to move so that the mail pieces are advanced one-by-one in serial fashion for downstream processing. In a first scenario, shown in FIGS. 4 and 5, the system 200 receives a single mail piece M from the feeder. The mail piece M initially enters the system 200 in a generally vertical orientation along a central axis of mail support 202, as shown in FIG. 4. As the mail piece M advances longitudinally along the support 202, it is drawn against the belt 220 of the vacuum assembly 204*b* by vacuum source 222, as shown in FIG. 5. In the position shown in FIG. 5, only the sensors 208*b*, 210*b*, and 212*b* on one side of the detection space S indicate the presence of a mail piece. Side sensors 208*a*, 210*a*, and 212*a*, and bottom sensor 206, do not indicate the presence of a mail piece. Based on these indications from the sensors, the controller (element 214 in FIG. 2) determines that there are no mail doubles in the detection space and allows both belts 220 to continue moving so that the mail piece M is advanced.

Figure 7:
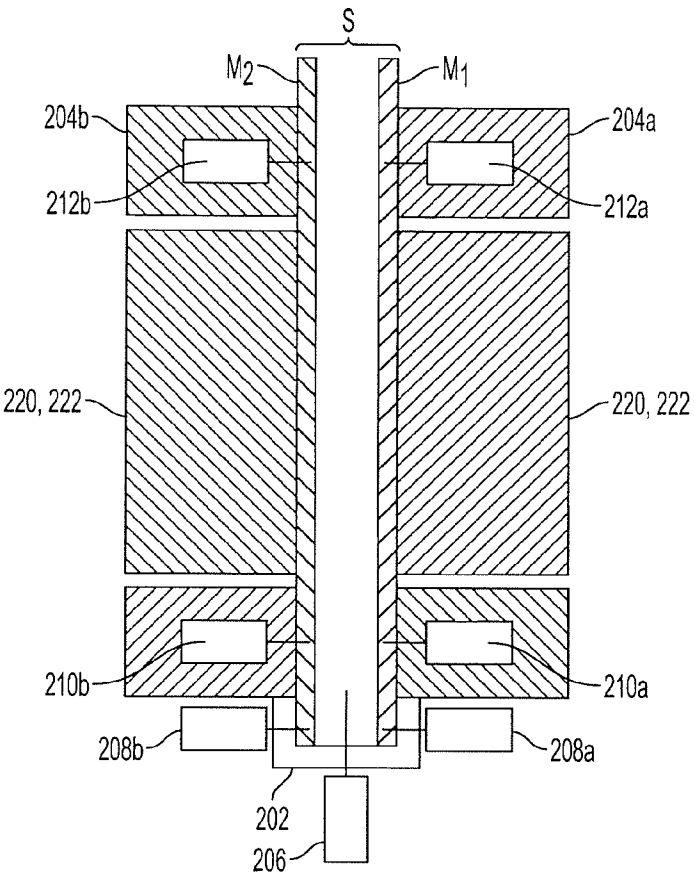
FIGS. 6 and 7 are cross-sectional views of a mail doubles detection and correction system according to an embodiment of the present invention, showing operation of the system when two mail pieces are inadvertently fed into the system by the feeder.
Figure 6:
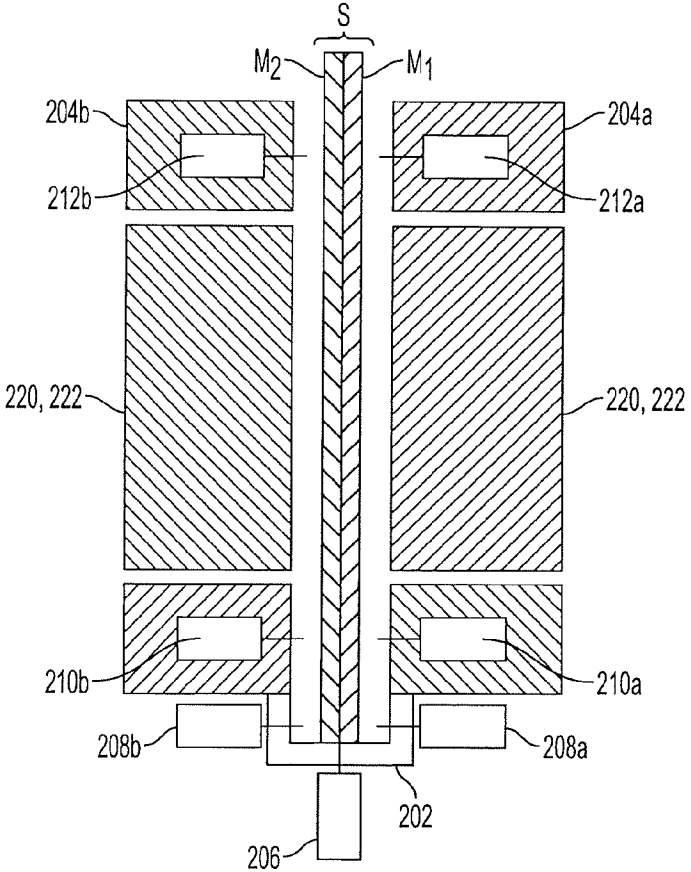
Figures 8A, 8B, 8C, 8D:
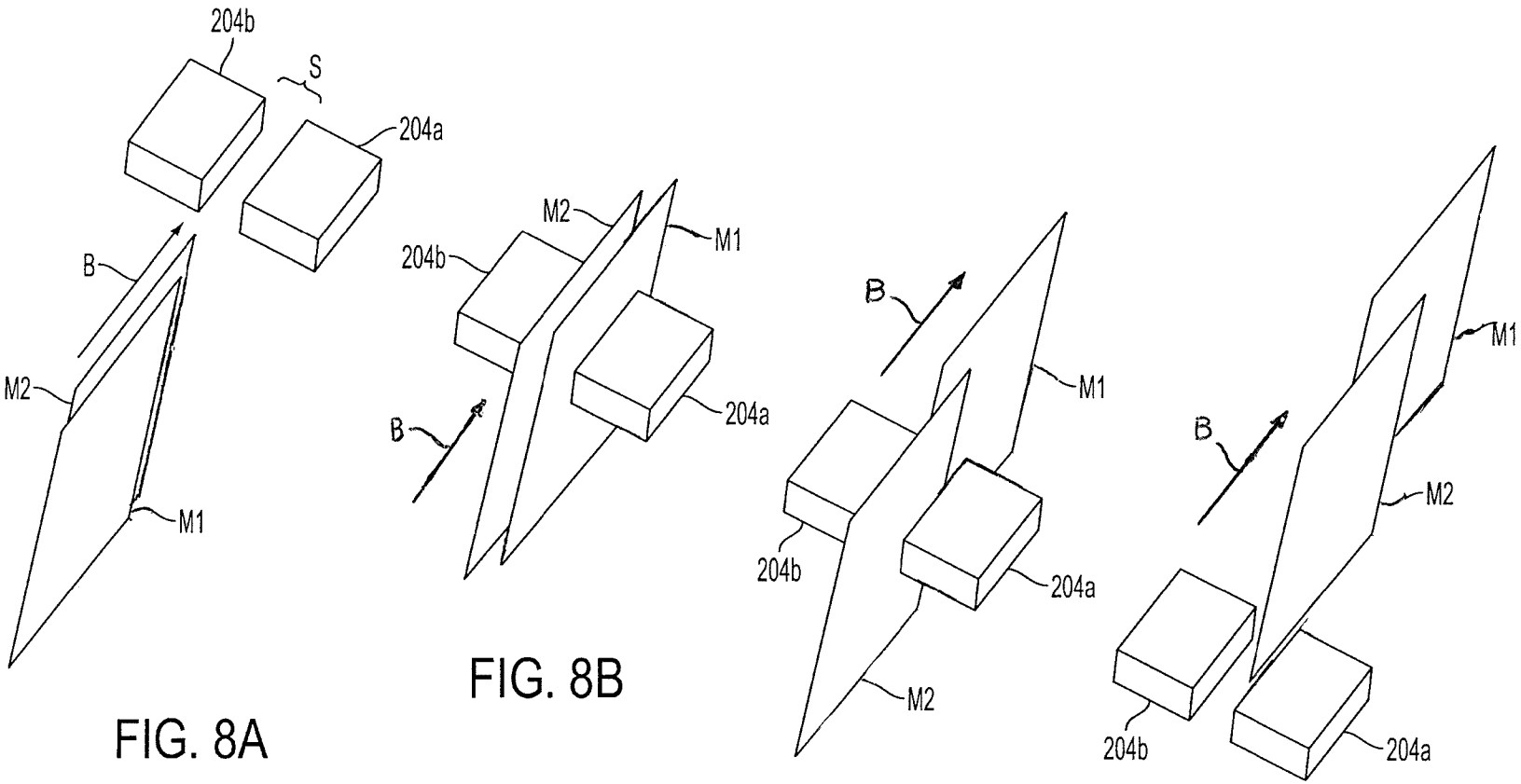
FIGS. 8(*a*)-8(*d*) are partial perspective views of a mail doubles detection and correction system according to an embodiment of the present invention, showing operation of the system when two pieces of mail are inadvertently fed into the system by the feeder.

In a second scenario, shown in FIGS. 6, 7 and 8(*a*)-(*d*), the system 200 receives two mail pieces M1 and M2 from the feeder 100. The doubled mail pieces M1 and M2 enter the system 200 side-by-side in a generally vertical orientation along a central axis of mail support 202, as seen in FIGS. 6 and 8(*a*). As the mail pieces M1 and M2 advance longitudinally along support 202, the vacuum sources 222 on opposed sides of the support pull the mail doubles apart so that one of the mail pieces M1 is drawn against the belt 220 of the first vacuum belt assembly 204(*a*) and the other mail piece M2 is drawn against the belt 220 of the second vacuum belt assembly 204(*b*), as shown in FIGS. 7 and 8(*b*). In the position shown in FIG. 7, the low, medium and high side sensors 208*a* & 208*b*, 210*a* & 210*b*, and 212*a* & 212*b* on both sides of the detection space S indicate the presence of a mail piece, while the bottom sensor 206 does not indicate the presence of a mail piece. Based on these indications from the sensors, the controller (element 214 in FIG. 2) determines that a mail double is in the detection space and stops one of the belts 220 to hold the double M2 back while the other belt 220 is allowed to continue moving so that the other mail piece Ml is advanced, as shown in FIG. 8(*c*). Once the system detects that the first mail piece M1 is clear (e.g., using photo eyes downstream of the system along the mail transport path B), the stationary belt resumes moving so that the double M2 is advanced in serial fashion after the first mail piece M1, as shown in FIG. 8(*d*). To handle cases where mail doubles are drawn against the belts above the low side sensors, the system can be configured to detect and correct a double when the high and medium sensors detect mail on both sides and the bottom sensor does not sense mail.

Figure 9:
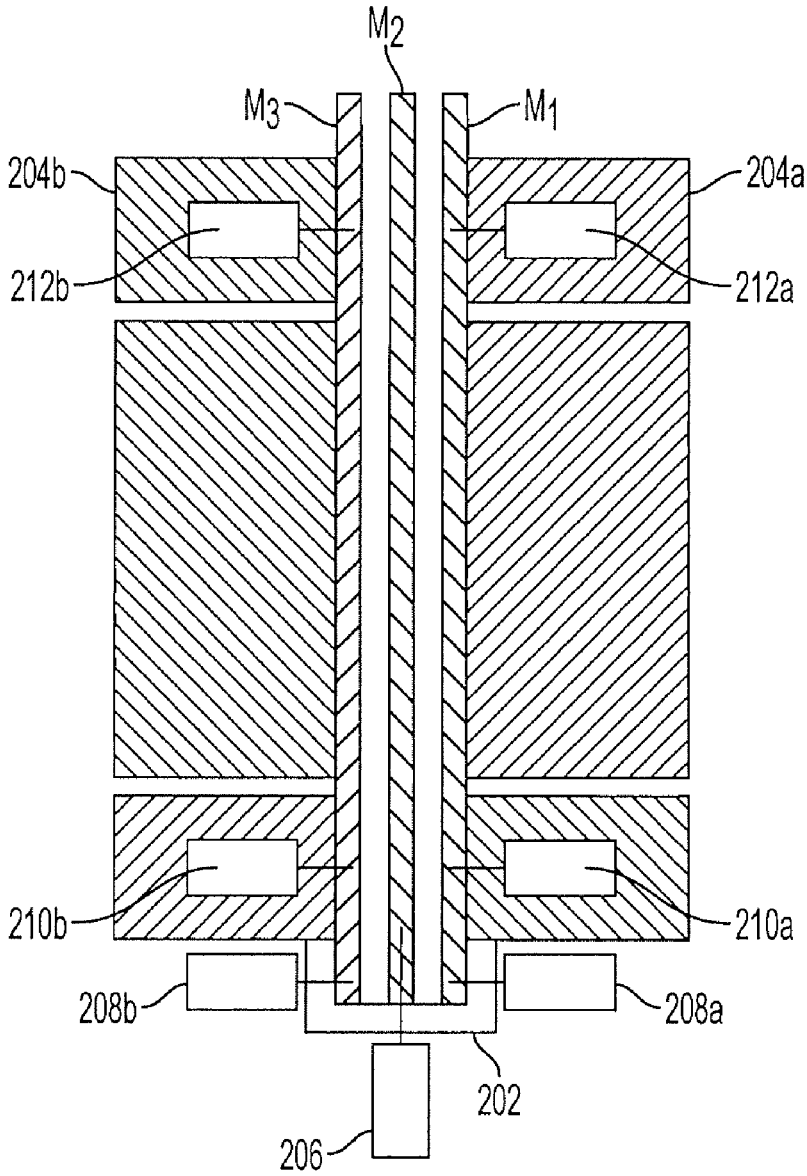
FIG. 9 is a cross-sectional view of a mail doubles detection and correction system according to an embodiment of the present invention, showing operation of the system when three mail pieces are inadvertently fed into the system by the feeder.

In a third scenario, shown in FIG. 9, the system 200 receives three mail pieces M1, M2 and M3 from the feeder 100. In this scenario, the outermost mail pieces M1 and M3 are drawn against belts 220 on opposite sides of the detection space while the middle mail piece M2 remains in the center of the support 202. Therefore, all of the sensors 206, 208*a* & 208*b*, 210*a* & 210*b*, and 212*a* & 212*b* will indicate the presence of a mail piece. However, in an embodiment, the controller (element 214 in FIG. 2) is configured to ignore indications from the bottom sensor 206 if both of the low side sensors 208*a* & 208*b* indicate the presence of a mail piece. The controller determines that a mail double exists and takes corrective action, as described above, by stopping one of the belts 220 to hold one of the mail pieces back while the other mail piece is advanced. In this case, however, the middle mail piece M2 is drawn against the first belt when the first mail piece M1 clears the system, resulting in another doubles determination, which can be resolved in the same manner.

Figure 11:
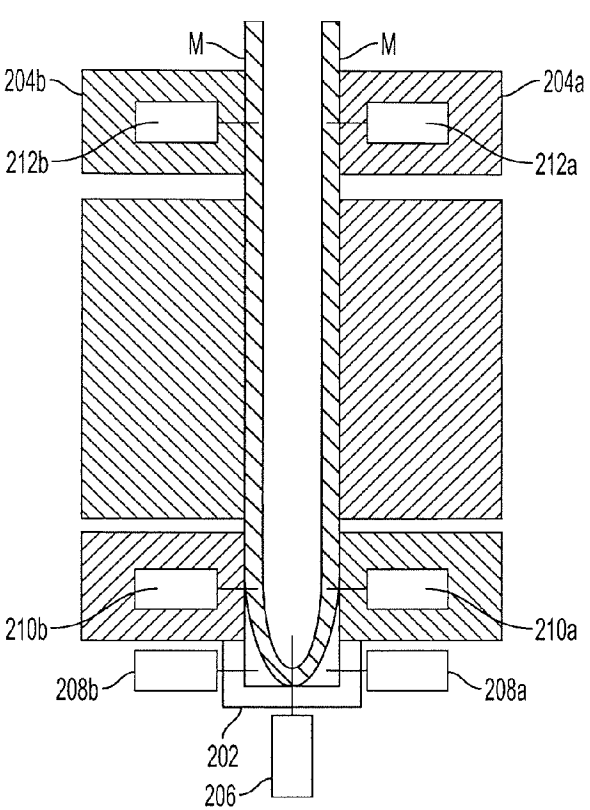
FIGS. 10 and 11 are cross-sectional views of a mail doubles detection and correction system according to an embodiment of the present invention, showing operation of the system when an open mail piece is fed into the system by the feeder.
Figure 10:
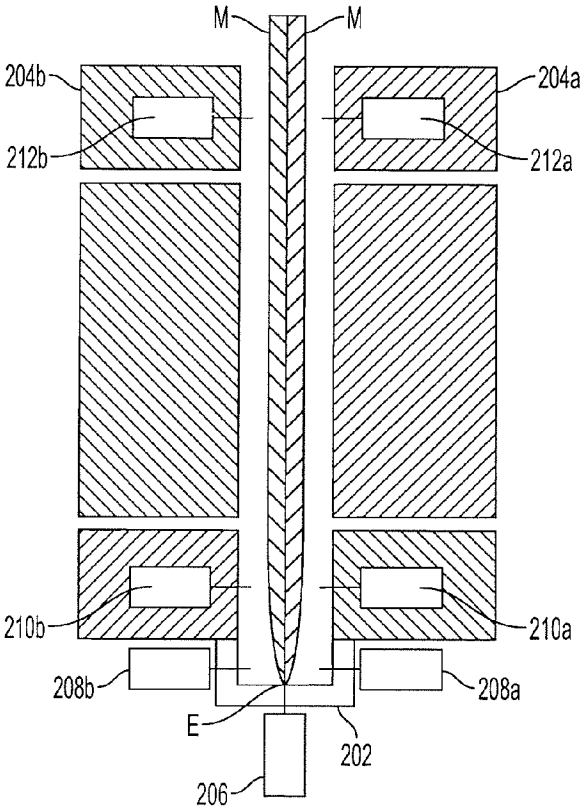
Figure 12C:
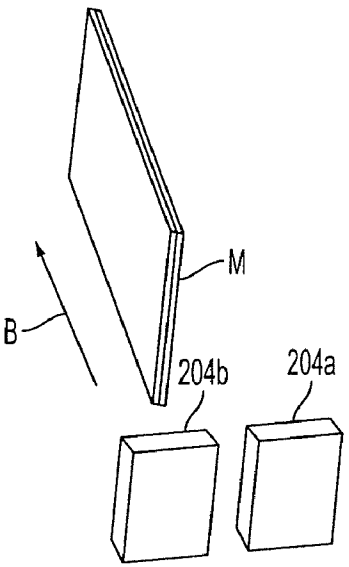
FIGS. 12(*a*)-(*c*) are partial perspective view of a mail doubles detection and correction system according to an embodiment of the present invention, showing operation of the system when an open mail piece is fed into the system by the feeder.
Figure 12B:
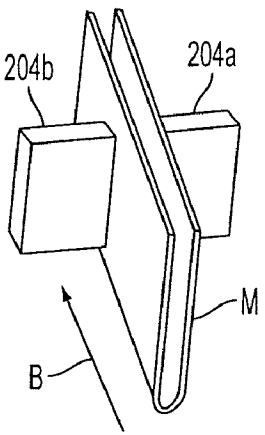
Figure 12A:
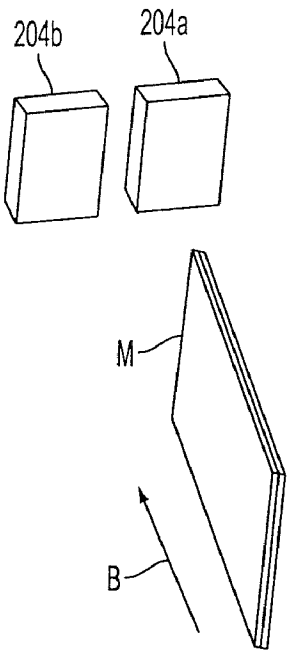

In a fourth scenario, shown in FIGS. 10, 11 and 12(*a*)-(*c*), the system 200 receives an open mail piece M from the feeder 100. Open mail pieces have a folded edge or spine E which will rest on support 202 upon entering the system, as shown in FIG. 10, and as sides of the mail piece are drawn against belts 220 on opposite sides of the space S by vacuum sources 222, as shown in FIG. 11. If the high and medium sensors indicate mail on both sides and the bottom sensor detects mail, but the low side sensors do not indicate mail, then the controller (element 214 in FIG. 2) determines that an open mail piece has been received and allows both belts to remain moving so that the open mail piece is moved downstream for further processing.

Figure 13:
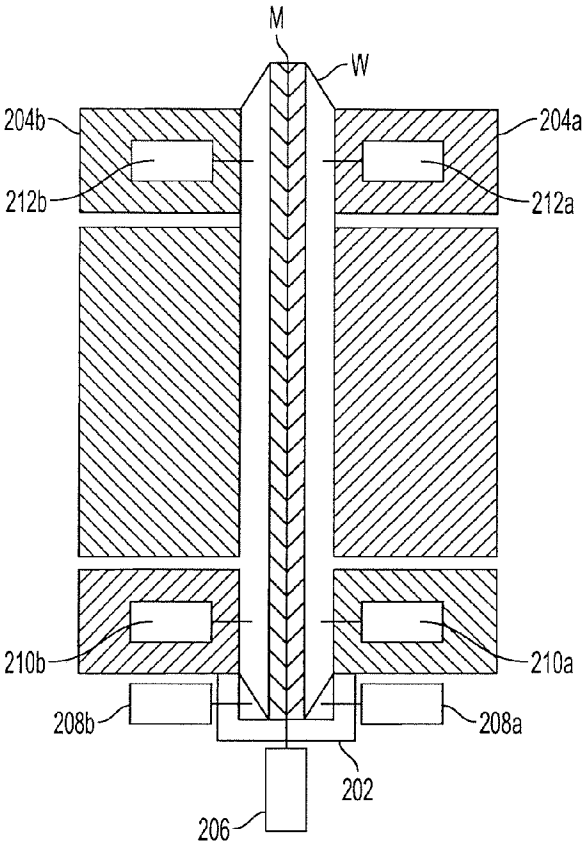
FIG. 13 is a cross-sectional view of a mail doubles detection and correction system according to an embodiment of the present invention, showing operation of the system when a plastic-wrapped mail piece is fed into the system by the feeder.

In a fifth scenario, shown in FIG. 13, the system 200 receives multiple mail pieces M1 and M2 that are individually wrapped in plastic W. Loose plastic wrap W may not allow a separating action as the mail pieces enter the space between the perforated belts 220, so the system may not be able to determine if there is more than one mail piece. To address this situation, the system is configured such that, if only the bottom sensor 206 detects presence of mail, the system stops one of the belts and lowers the vacuum level on that side so that, if a single mail piece is present, it will pass through under the influence of the moving belt; and, if more than one mail piece is present, the doubles will be singulated in the manner described above.

Figure 1:
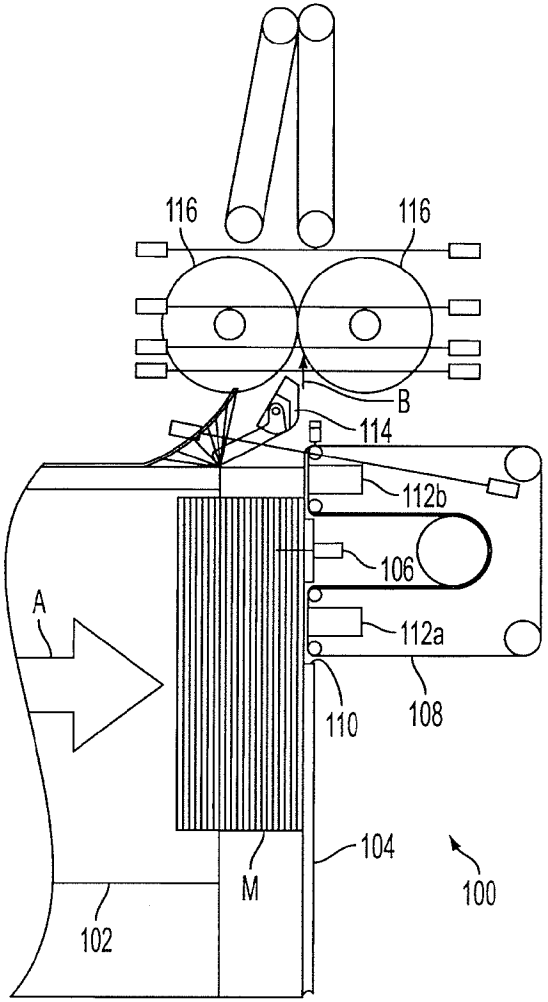
FIG. 1 is a top view of a prior art mail feeder with a conventional anti-doubler mechanism
Figure 14:
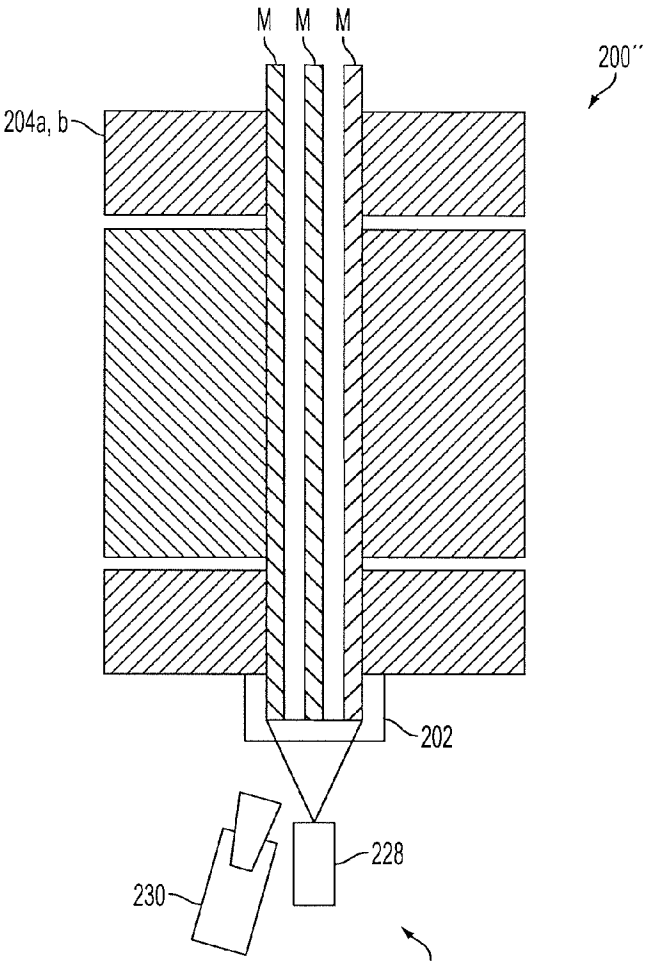
FIG. 14 is a cross-sectional view of a mail doubles detection and correction system according to another embodiment of the present invention.

FIG. 14 is a cross-sectional view of a modification of an anti-doubling system 200' according to the present invention wherein the mail support 202 is optically transmissive or provided with an optically transmissive window, and the bottom sensor 206 includes a light source 228, such as a laser, configured to illuminate the edges of mail pieces in the detection space S and a camera 230 oriented to capture an image of the illuminated mail pieces. It will be appreciated that output from camera 230 can be sent to controller 214 (See FIG. 1) for use in determining whether multiple mail pieces are disposed within the detection space.

Figure 15:
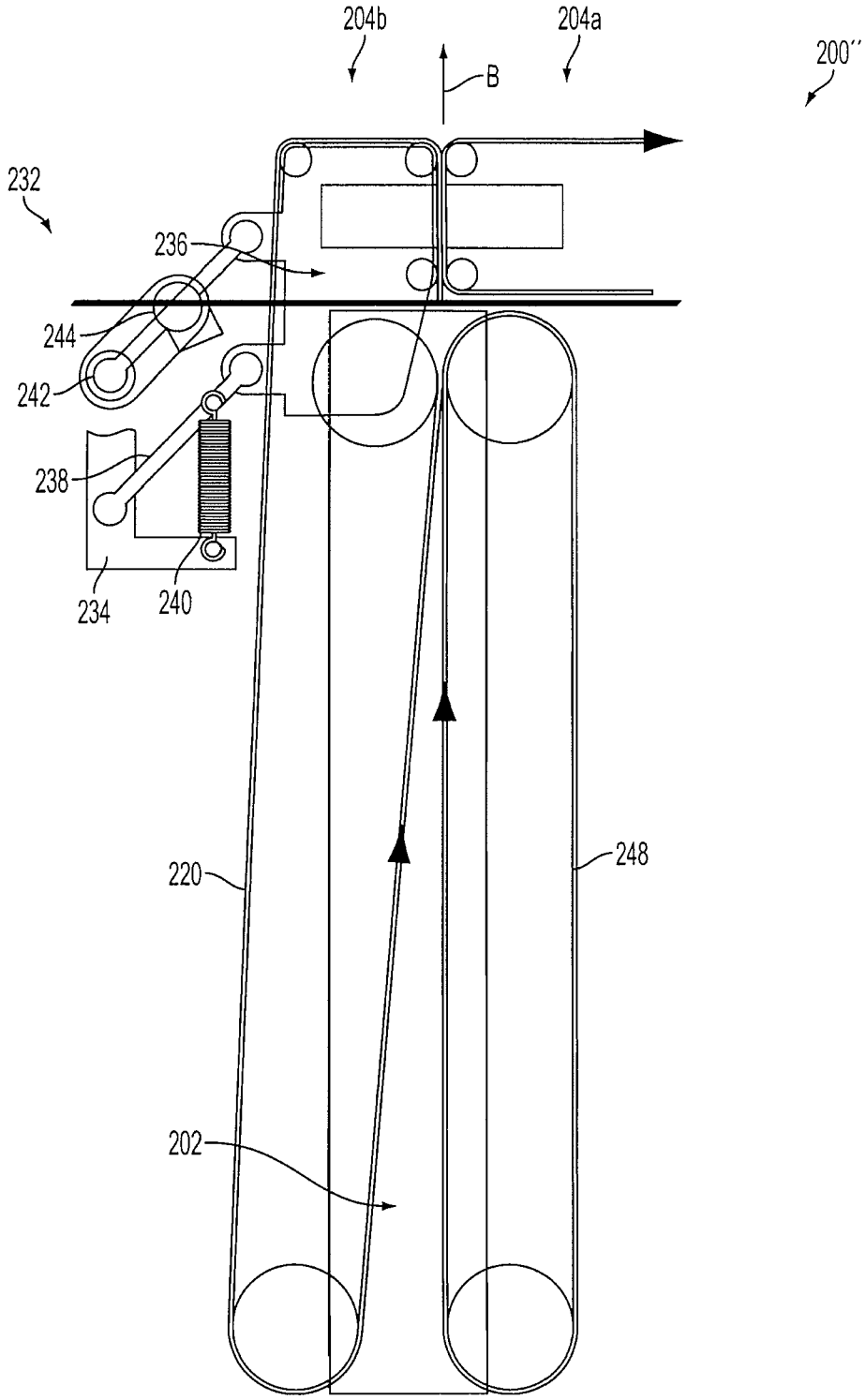
FIG. 15 is a top view of a mail doubles detection and correction system according to yet another embodiment of the present invention.

In all of the foregoing scenarios, one side of the support channel can optionally be made to move perpendicular to the direction of travel of the mail so that the width can be adjusted based on mail thickness. A width detection device can be used upstream of the support channel to provide information used to adjust the width of the detection space. A modification of an anti-doubling system with width adjustment according to the present invention is shown in FIG. 15 at 200". The modified system 200" is similar to the system 200 shown in FIGS. 2-5 but includes a mechanism 232 for adjusting the width of the detecting space S between vacuum belt assemblies 204*a* & 204*b* to accommodate single and multiple mail pieces of various widths. The mechanism 232 includes a non-moving frame 234 that is fixed and a moving frame 236 that is connected to the non-moving frame by pivoting links 238 that allow the moving frame to be moved back and forth in a lateral direction perpendicular to the mail transport path B. In an embodiment, one of the vacuum belt assemblies 204*b* is mounted on the moving frame 236 to allow adjustment of the gap between the belt assemblies so that the width of the detection space can be increased for incoming mail pieces exceeding a specified nominal or threshold width. In an embodiment, a tension spring 240 is connected between a pivoting link 238 and the non-moving frame 234 to normally bias the movable vacuum belt assembly 204*b* towards the other vacuum belt assembly 204*a*. A stop (not shown) can be provided to maintain a nominal gap or width between the vacuum belt assemblies. A rotary actuator 242 and pneumatic clamp 244 can also be provided to remove friction between doubled pieces. The modified system 200" also differs from system 200 in that the perforated belt 220 of assembly 204*b* is extended longitudinally in comparison with the other assembly 204*a* to form an input stage with a third belt 248, and the mail support 202 is defined by the horizontal run of a conveyor belt.

The system may also include an optional width detection device disposed upstream of the mail support channel 202. In an embodiment, the width detection device 226 is incorporated into the anti-doubling device 114 of the feeder 100 and connected with the controller 214. Width information from detection device 226 may be used by the controller 214 to control actuators and/or servos that are part of an automatic width adjustment mechanism.

While the invention has been particularly taught and described with reference to certain preferred embodiments, those versed in the art will appreciate that modifications in form and detail may be made without departing from the spirit and scope of the invention. For example, sides of the mail support channel can extend high enough to provide lateral support for most mail pieces, in which case the perforated belts can be looped through windows in the channel sides. Permanent vacuum ports can be disposed adjacent the windows to draw mail pieces toward the belts, and separate vacuum sources can be disposed behind the belts to aid in moving the mail pieces. By way of further example, the pivoting links in FIG. 15 can be replaced by one or more linear servo actuators configured to move the vacuum belt assembly back and forth in a transverse direction to adjust the width of the detecting space for incoming mail piece thickness. In still another example, the controller may be a dedicated controller for the system or may be a multi-purpose controller that also performs other functions relating to mail processing. Furthermore, while the system has been shown and described for use with conventional AFSM mail processing equipment, it will be appreciated that the system can be used in other types of mail processing equipment, including but not limited to the flats sequencing system (FSS). These and other modifications of the present invention are intended to be within the scope of the appended claims.

What is claimed is:

1. A mail doubles detection and correction system for a mail processing system with a feeder, said mail doubles detection and correction system comprising:

a mail support configured to support one or more mail pieces in a detection space downstream of the feeder;

a pair of vacuum belt assemblies disposed on opposite sides of said detection space, each vacuum belt assembly including a vacuum port facing said detection space and a perforated belt movable across said vacuum port in a mail transport direction;

one or more sensors positioned about said detection space to detect a position of one or more mail pieces in said detection space; and a controller configured to detect misfeeds based on indications from said one or more sensors and to correct misfeeds by selectively stopping one of said perforated belts while moving the other of said perforated belts.

2. A mail doubles detection and correction system as recited in claim 1, wherein said vacuum belt assemblies are configured to simultaneously draw a vacuum when one or mail pieces are disposed in said detection space.

3. A mail doubles detection and correction system as recited in claim 2, wherein said vacuum belt assemblies are configured to continuously draw a vacuum.

4. A mail doubles detection and correction system as recited in claim 2, wherein said one or more sensors are positioned about said mail support and said vacuum belt assemblies to indicate a respective position of said one or more mail pieces reacting to said vacuum in said detecting space.

5. A mail doubles detection and correction system as recited in claim 4, wherein said one or more sensors includes a bottom sensor positioned about a bottom of said detection space and a plurality of side sensors positioned at vertically spaced positions about opposite sides of said detection space.

6. A mail doubles detection and correction system as recited in claim 1, wherein said one or more sensors includes a bottom sensor positioned about a bottom of said detection space and a plurality of side sensors positioned at vertically spaced positions about opposite sides of said detection space.

7. A mail doubles detection and correction system as recited in claim 6, wherein said controller is configured to move one of said perforated belts in a transport direction while holding the other of said perforated belts stationary when a misfeed is detected.

8. A mail doubles detection and correction system as recited in claim 7, wherein said controller is configured to detect a misfeed when lowermost side sensors on both sides of said detection space indicate proximity of a mail piece.

9. A mail doubles detection and correction system as recited in claim 6, wherein said controller is configured to move both of said perforated belts in a transport direction when a normal feed is detected.

10. A mail doubles detection and correction system as recited in claim 9, wherein said controller is configured to detect a normal feed when side sensors on only one side of said detection space indicate proximity of a mail piece or when said bottom sensor indicates proximity of a mail piece and lowermost side sensors do not indicate proximity of mail pieces.

11. A mail doubles detection and correction system as recited in claim 1, wherein at least one of said vacuum belt assemblies is movable in a direction transverse to said mail transport direction to adjust a width of said detection space.

12. A mail doubles detection and correction system as recited in claim 11, further comprising a width sensor disposed upstream of said detection space, wherein said controller is configured to move said at least one of said vacuum belt assemblies based on information from said width sensor.

13. A mail processing system including a feeder and a mail doubles detection and correction system as recited in claim 1.

14. A method of detecting and correcting mail doubles in a mail processing system, comprising the steps of receiving one or more mail pieces in a detection space between a pair of perforated belts;

drawing a vacuum on each side of said detection space;

sensing proximity of said one or more mail pieces at vertically spaced locations on opposite sides of said detection space and a bottom of said detection space;

determining whether one or more mail pieces are disposed in said detection space based on said sensing step; and selectively moving one or both belts based on said determining step.

15. A method of detecting and correcting mail doubles as recited in claim 14, wherein said determining step includes one of the steps of:

(a) determining that more than one mail piece is disposed in said detection space when lowermost side sensors on both sides of said detection space indicate proximity of a mail piece;

(b) determining that only one mail piece is disposed in said detection space when side sensors on only one side of said detection space indicate proximity of a mail piece; and (c) determining that only one mail piece is disposed in said detection space when a bottom sensor and side sensors other than the lowermost side sensors indicate proximity of a mail piece.

16. A method of detecting and correcting mail doubles as recited in claim 15, wherein in response to a determination that more than one mail piece is disposed in said detection space, said moving step includes the step of moving one of said belts and holding the other of said belts stationary to advance one of said mail pieces.

17. A method of detecting and correcting mail doubles as recited in claim 16, wherein said moving step subsequently includes moving both of said belts to advance a remaining mail piece.

18. A method of detecting and correcting mail doubles as recited in claim 15, wherein in response to a determination that only one mail piece is disposed in said detection space, said moving step includes the step of moving both of said belts to advance said mail piece.

19. A method of detecting and correcting mail doubles as recited in claim 14, wherein said receiving step includes automatically adjusting a width of said detection space to accommodate a width of said one or more mail pieces.

20. A method of detecting and correcting mail doubles as recited in claim 19, wherein said adjusting step includes the steps of measuring a width of said one or more mail pieces and moving at least one of said perforated belts to accommodate the measured width.

* * * * *